US005306604A

United States Patent [19]

Krishnamurthy

[11] Patent Number: 5,306,604

[45] Date of Patent: Apr. 26, 1994

[54] PHOTOGRAPHIC SILVER HALIDE MATERIAL CONTAINING A COUPLER HAVING IN A NON-COUPLING POSITION IN A SILYL SUBSTITUENT

[75] Inventor: Sundaram Krishnamurthy, Penfield, N.Y.

[73] Assignee: Eastman Kodak Company, Rochester, N.Y.

[21] Appl. No.: 987,047

[22] Filed: Dec. 7, 1992

[51] Int. Cl.[5] ..... G03C 1/08; G03C 7/26; G03C 7/32

[52] U.S. Cl. ..... 430/376; 430/552; 430/553; 430/554; 430/555; 430/556; 430/557; 430/558; 430/503; 548/110; 556/465; 556/400; 556/482

[58] Field of Search ..... 430/553, 555, 557, 558, 430/503, 543, 376; 548/110; 556/465, 400, 482

[56] References Cited

U.S. PATENT DOCUMENTS

| | | | |
|---|---|---|---|
| 3,772,002 | 11/1973 | Ramello | 96/100 |
| 4,824,771 | 4/1989 | Buckland et al. | 430/557 |
| 4,973,545 | 11/1990 | Moore | 430/553 |
| 5,128,238 | 7/1992 | Nakazyo et al. | 430/547 |

*Primary Examiner*—Charles L. Bowers, Jr.

*Assistant Examiner*—Geraldine Letscher

*Attorney, Agent, or Firm*—Arthur E. Kluegel

[57] ABSTRACT

Photographic silver halide materials are disclosed comprising a support and a silver halide emulsion layer having associated therewith a coupler having in a non-coupling position a silyl substituent represented by the formula:

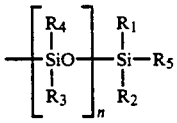

wherein $R_1$ through $R_4$ individually are unsubstituted or substituted aliphatic, aromatic or heterocyclic groups, $R_5$ is an unsubstituted or substituted aliphatic, aromatic or heterocyclic group which can be bonded to a non-coupling position of a second coupler moiety, and n=0, 1 or 2. In a preferred embodiment, the coupler is a photographic image dye-forming coupler. Processes for developing images in the photographic materials are also disclosed.

31 Claims, No Drawings

PHOTOGRAPHIC SILVER HALIDE MATERIAL CONTAINING A COUPLER HAVING IN A NON-COUPLING POSITION IN A SILYL SUBSTITUENT

BACKGROUND OF THE INVENTION

This invention relates to photographic couplers that comprise a silyl substituent in a non-coupling position, and to photographic materials and processes using such compounds.

Images are commonly obtained in the photographic art by a coupling reaction between the development product of a silver halide color developing agent, particularly an oxidized aromatic primary amino developing agent, and a color forming compound commonly described as a coupler. The dyes formed vary depending upon the composition of the coupler and the developing agent. The subtractive process of color formation is typically employed in multicolor photographic elements. Resulting dyes are typically cyan, magenta and yellow dyes formed in or adjacent to silver halide layers sensitive to radiation complementary to the radiation absorbed by the image dyes, that is, silver halide emulsions sensitive to red, green and blue radiation.

Couplers that contain various substituents in the non-coupling positions of the couplers are known. Examples of such couplers are described, for example, in U.S. Pat. No. 3,772,002, and in *Research Disclosure,* December 1978, Item 17643, Section VII. These substituents serve different functions, acting, for example, as ballast groups or groups that affect the solubility or dispersibility of the coupler, or the hue of the dye formed from the coupler.

There has been a need for a new class of couplers comprising substituent groups in non-coupling positions of the couplers that enable modification of the hue of the dye formed upon oxidative coupling of the coupler without significantly adversely affecting other desired properties of the coupler, such as image stability, dispersibility, and low melting point.

SUMMARY OF THE INVENTION

These needs have been satisfied by providing a coupler comprising a coupler moiety having in a non-coupling position a silyl substituent represented by the formula:

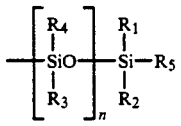

wherein $R_1$ through $R_4$ individually are unsubstituted or substituted aliphatic, aromatic or heterocyclic groups; $R_5$ is an unsubstituted or substituted aliphatic, aromatic or heterocyclic group which can be bonded to a non-coupling position of a second coupler moiety; and n=0, 1 or 2.

In a preferred embodiment, the coupler is a photographic image dye-forming coupler.

There are also provided photographic elements and emulsions comprising photographic couplers according to the invention, and processes for developing an image in a photographic element using said photographic couplers.

DETAILED DESCRIPTION OF THE INVENTION

Related couplers and methods for producing them are disclosed in U.S. Ser. Nos. 07/986,841 and 07/986,240, filed simultaneously herewith and incorporated in their entireties by reference herein.

The inventive couplers provide dyes with markedly more bathochromic hues, better image stability, and better dispersibility due to lower melting points compared to non-silyl analogs.

In a preferred embodiment of the invention, the photographic coupler is represented by the formula:

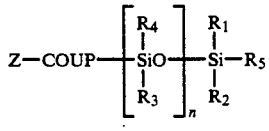

wherein

COUP is a coupler moiety;

Z is H or a coupling-off group bonded to a coupling position of COUP;

$R_1$–$R_5$ individually are unsubstituted or substituted aliphatic, aromatic or heterocyclic groups; and n is 0, 1 or 2.

In another preferred embodiment of the invention, the photographic coupler is a dimer represented by the formula:

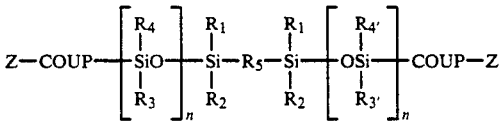

wherein COUP, Z, $R_1$–$R_5$ and n are as defined above, $R_3$, and $R_4$, are as $R_1$–$R_5$, and wherein COUP and Z can each be the same or different coupler moieties and coupling-off groups, respectively. Preferably, $R_5$ is a $(—CH_2—)_z$ group, with z=1–30, particularly preferably 1–8.

The term COUP herein means a coupler moiety as used in the photographic art. The coupler moiety can be any moiety that will react with an oxidized color developing agent to form a product, particularly to form a dye. It includes coupler moieties that form colored products on reaction with oxidized color developing agents, for example, any cyan, magenta or yellow dye-forming coupler moiety, and coupler moieties that form colorless products on such a reaction. Typical coupler moieties to which the described silyl group can be bonded are described below.

Representative couplers which form cyan dyes upon reaction with oxidized color developing agent are described in the following patents and publications: U.S. Pat. Nos. 2,367,531; 2,423,730; 2,474,293; 2,772,162; 2,801,171; 2,895,826; 3,002,836; 3,034,892; 3,041,236; 3,419,390; 3,476,563; 3,772,002; 3,779,763; 3,996,253; 4,124,396; 4,254,212; 4,296,200; 4,333,999; 4,443,536; 4,457,559; 4,500,635; 4,526,864; 4,690,889; 4,775,616; and in "Farbkuppler—ein Literaturübersicht," published in Agfa Mitteilungen, Band III, pp. 156–175 (1961). Preferred couplers are phenols and naphthols. Exemplary coupler moieties include:

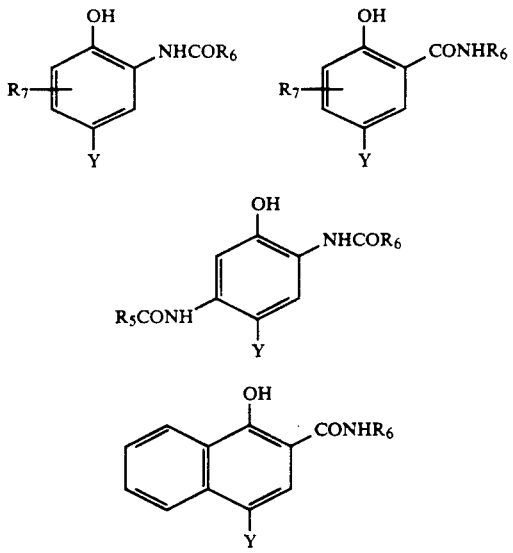

where $R_6$ represents a ballast group, $R_7$ represents halogen, $C_{1-4}$ alkyl, or $C_{1-4}$ alkoxy, and Y is H or a coupling-off group. Preferred $R_7$ groups include Cl, F, methyl, ethyl, butyl, methoxy, ethoxy and butoxy.

Representative couplers that form magenta dyes upon reaction with oxidized color developing agent are described in U.S. Pat. Nos. 1,269,479; 2,311,082; 2,343,703; 2,369,489; 2,600,788; 2,673,801; 2,908,573; 3,061,432; 3,062,653: 3,152,896; 3,519,429; 3,725,067; 3,935,015; 4,120,723; 4,443,536; 4,500,630; 4,540,654; 4,581,326; 4,774,172; European Patent Applications 170,164; 177,765; 284,239; 284,240; and in "Farbkuppler—ein Literaturübersicht," published in Agfa Mitteilungen, Band III, pp. 126–156 (1961). Preferred couplers are pyrazolones, pyrazolotriazoles and pyrazolobenzimidazoles. Exemplary couplers moieties include the following:

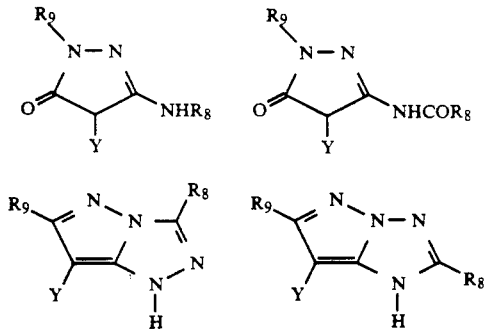

wherein $R_8$ and $R_9$ are independently a ballast group, unsubstituted or substituted alkyl, phenyl or substituted phenyl.

Typical couplers which form yellow dyes upon reaction with oxidized color developing agents are described in U.S. Pat. Nos. 2,298,443; 2,407,210; 2,875,057; 3,048,194; 3,265,506; 3,384,657; 3,415,652; 3,447,928; 3,542,840; 3,894,875; 3,933,501; 4,022,620; 4,046,575; 4,095,983; 4,182,630; 4,203,768; 4,221,860; 4,326,024; 4,401,752; 4,443,536; 4,529,691; 4,587,205; 4,587,207; 4,617,256; European Patent Application 296,793; and in "Farbkuppler—ein Literaturübersicht," published in Agfa Mitteilungen, Band III, pp. 112–126 (1961). Preferred yellow dye forming couplers are acylacetanilides such as benzoylacetanilides and pivalylacetanilides. Exemplary coupler moieties include the following:

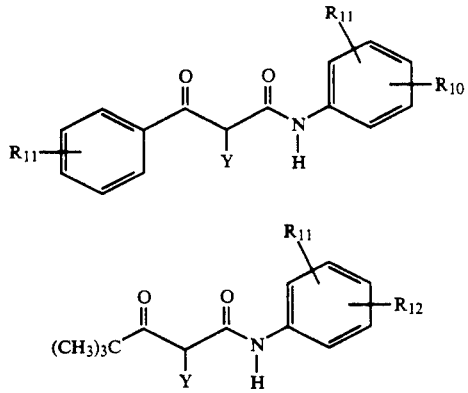

wherein $R_{10}$ is a ballast group, unsubstituted or substituted alkyl, phenyl or substituted phenyl as described above, and $R_{11}$ and $R_{12}$ are independently hydrogen, halogen, $C_{1-4}$ alkyl, or a ballast group such as $C_{16-20}$ alkoxy.

Couplers which form colorless products upon reaction with oxidized color developing agent are described in U.K. Pat. No. 861,138; U.S. Pat. Nos. 3,632,345; 3,928,041; 3,958,993; and 3,961,959. Preferably such couplers are cyclic carbonyl containing compounds that have the coupling-off group attached to the carbon atom in the α-position with respect to the carbonyl group. Structures of preferred colorless coupler moieties include the following:

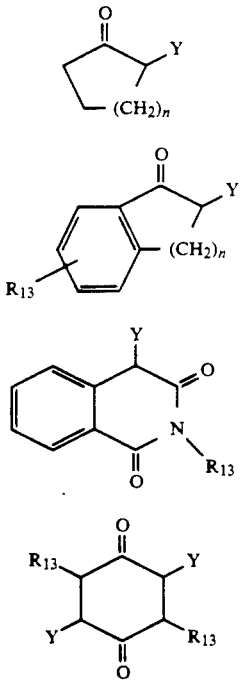

wherein $R_{13}$ is a ballast group, unsubstituted or substituted alkyl, phenyl or substituted phenyl, as described above, and n is 1 or 2.

Couplers which form black dyes upon reaction with oxidized color developing agents are described, for example, in U.S. Pat. Nos. 1,939,231; 2,181,944; 2,333,106; and 4,126,461; German OLS No. 2,644,194 and 2,650,764. Preferred couplers are resorcinols or m-aminophenols having the coupling-off group para to a hydroxyl group. Structures of preferred coupler moieties include the following:

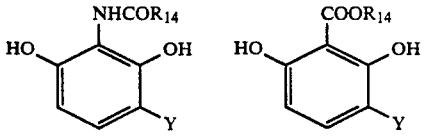

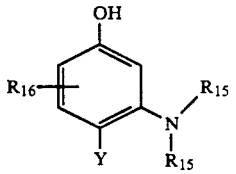

wherein $R_{14}$ is $C_{3-20}$ alkyl, phenyl, which can be substituted with hydroxy, halo, amino, $C_{1-20}$ alkyl or $C_{1-20}$ alkoxy, each $R_{15}$ is independently hydrogen, $C_{1-20}$ alkyl, $C_{2-20}$ alkenyl, or $C_{6-20}$ aryl; and $R_{16}$ is halogen, $C_{1-20}$ alkyl, $C_{1-20}$ alkoxy, or a similar monovalent organic group.

Additional coupler moieties to which the above-described coupling-off group can be attached are described, for example, in U.S. Pat. No. 4,248,962 and WO 88/04795. Universal couplers, as known to those skilled in the art, can also be used.

The silyl group preferably is bonded directly to the nucleus of the coupler moiety. The silyl group is not bonded through an oxygen atom or other linking atom or group to the coupler nucleus.

$R_1$–$R_5$ can be any unsubstituted or substituted aliphatic, aromatic or heterocyclic group that is compatible with the photographic coupler moiety and does not adversely affect the photographic properties of the photographic material or process in which the coupler is used. Each of $R_1$–$R_5$ can, for example, contain 1 to 30 carbon atoms. Illustrative groups include:

$-CH_3$ $-C_2H_5$ $-C_3H_{7\text{-}n}$ $-C_3H_{7\text{-}i}$ $-C_4H_{9\text{-}n}$ $-C_4H_{9\text{-}i}$ $-C_4H_{9\text{-}s}$ $-C_4H_{9\text{-}t}$ $-CH_2Cl$ $-CH_2CH_2CH_2Cl$ $n\text{-}C_4H_9CH(C_2H_5)CH_2-$ $CH_3O-$ $CH_3CH_2O-$ $i\text{-}C_4H_9O-$ $s\text{-}C_4H_9O-$ $t\text{-}C_4H_9O-$ $-CH_2CH_2C_5F_{13}$ $-(CH_2)_{10}COOCH_3$ $-CH{=}CH_2$

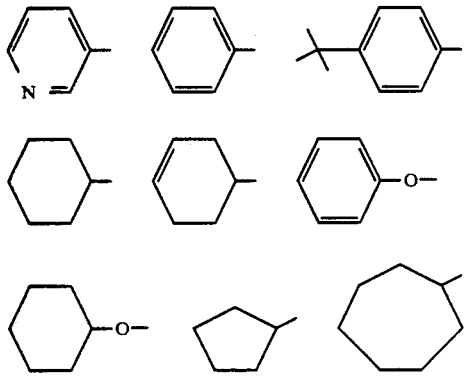

-continued

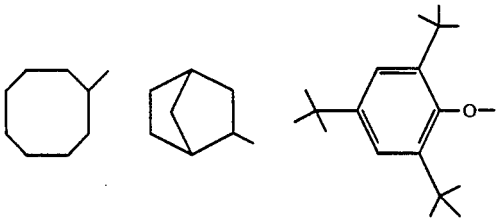

$R_1$–$R_5$ preferably are alkyl groups, such as alkyl groups containing 1 to 30 carbon atoms. Exemplary alkyl groups include methyl, ethyl, propyl, n-butyl, t-butyl, pentyl, octyl, eicosyl, and triacontyl. $R_1$–$R_5$ can be unsubstituted or substituted with groups that do not adversely affect the properties of the coupler or the photographic element of the invention. The $R_1$–$R_5$ groups can be optionally substituted with, for example, halogen (such as Cl, Br or F), hydroxy, carboxy, alkoxy, sulfonamido ($-NHSO_2R_x$, wherein $R_x$ is alkyl or aryl), sulfamyl ($-SO_2NHR_y$, wherein $R_y$ is alkyl or aryl), amino carbonamido, sulfonyl, aryloxy, alkyl (preferably methyl, ethyl or n-butyl), alkoxy, and aryl (such as phenyl).

When the inventive coupler is a dimer, $R_5$ preferably is an alkyl group containing 1 to 30 carbon atoms, particularly $(-CH_2-)_z$, wherein $z=1$–30, specifically 1–8.

The described aryl and heterocyclic groups can also be unsubstituted or optionally substituted with groups that do not adversely affect the desired properties of the couplers or dyes formed from the couplers. The aryl group can contain, for example, 6 to 30 carbon atoms. Phenyl and naphthyl groups are illustrative aryl groups. The substituents can be, for example, halogen (such as Cl, Br and F); $C_{1-30}$ alkyl, such as methyl, ethyl, propyl, n-butyl, t-butyl, pentyl, octyl, eicosyl, or triacontyl; hydroxy, carboxy, nitro, alkoxy, sulfonamido, sulfamyl, carbonamido, sulfonyl, aryloxy, alkyl, aryl, carboxylic esters, and heterocyclic groups.

Substituents on the described couplers can include ballast groups that are known to be useful in the photographic art. In addition, as described above, the couplers can be monomeric or dimeric. Additionally, the inventive couplers can be oligomeric or polymeric (i.e., "substituents" can include additional coupler moieties).

The coupler moiety can be unballasted or ballasted. In other words, the coupler moiety can optionally include a group of such molecular size and configuration as to render the coupler nondiffusible from the layer in which it is coated in a photographic element. Ballast groups are described, for example, in U.S. Pat. Nos. 4,420,556 and 4,923,789. Couplers as described can be attached to ballast groups or to polymeric chains through one or more of the groups of the coupler moiety or through the coupling-off group. For example, one or more of the couplers can be attached to the same ballast group. Representative ballast groups include unsubstituted or substituted alkyl or aryl groups containing 8 to 32 carbon atoms. Representative ballast groups include ethers, thioethers, sulfones as well as carboxylic, sulfonic and phosphoric esters and amides containing unsubstituted or substituted alkyl or aryl groups comprising about 8 to 32 carbon atoms. Representative substituents include alkyl, aryl, alkoxy, aryloxy, alkylthio, arylthio, hydroxy, halogen, alkoxycarbonyl, aryloxycarbonyl, carboxy, acyl, acyloxy, amino, anilino, carbonamido, carbamoyl, alkanesulfonyl, arenesulfonyl, sulfonamido and sulfamyl groups. The alkyl portion of these substituents can contain, for example, 1 to 30 carbon atoms. The aryl portion of these substituents can contain, for example, 6 to 30 carbon atoms.

The coupler moiety can be monomeric, or it can form part of a dimeric, oligomeric or polymeric coupler.

The couplers as described can be used in ways and for purposes that dye-forming couplers have been used in the photographic art.

Examples of such couplers include:

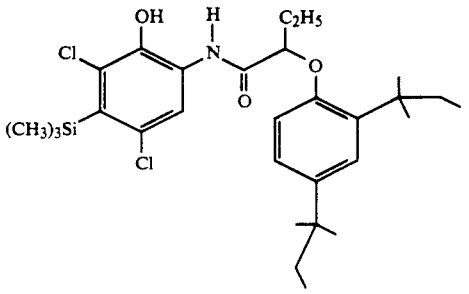

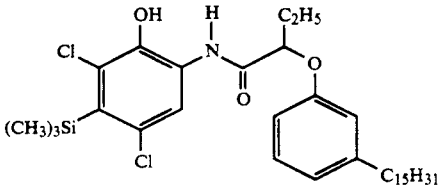

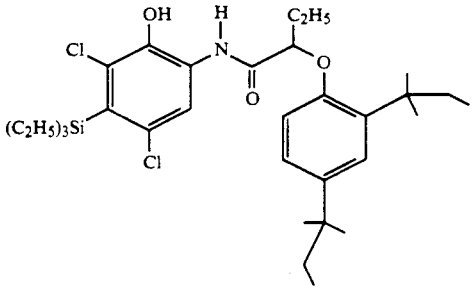

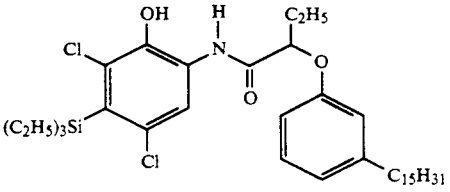

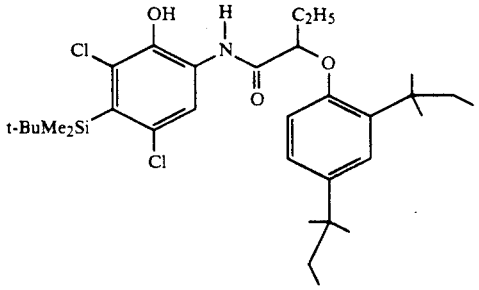

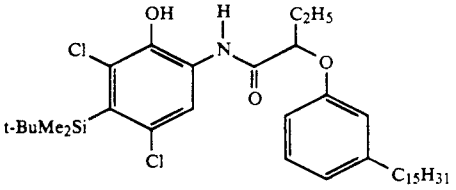

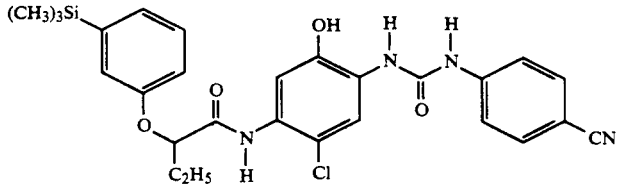

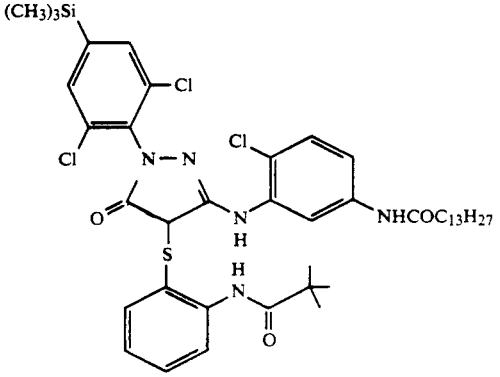

-continued

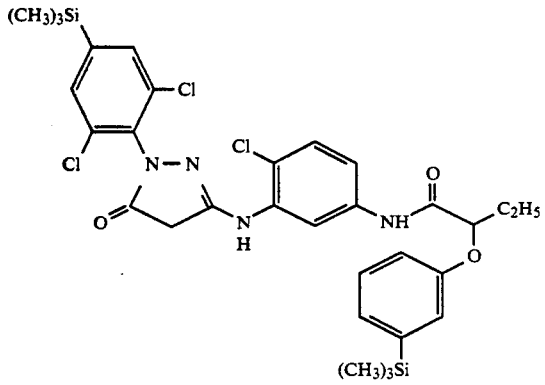

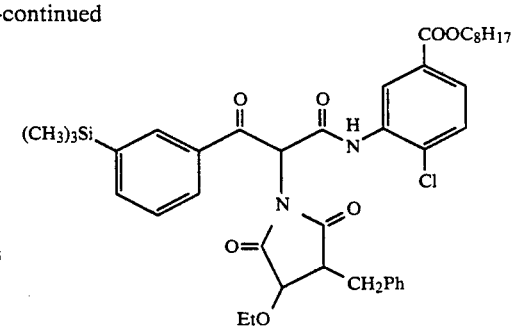

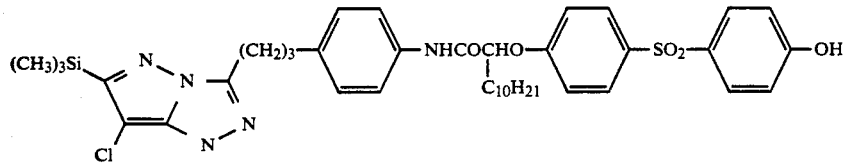

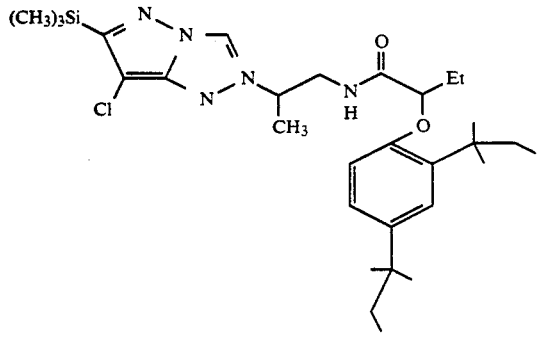

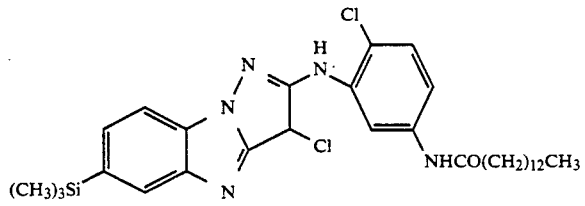

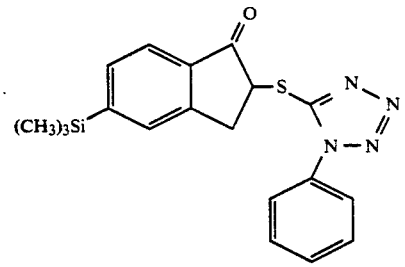

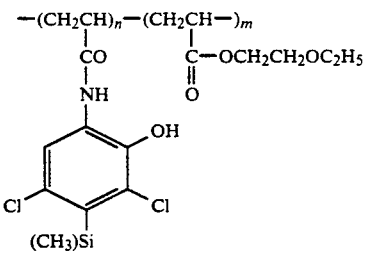

The photographic couplers according to the invention can be prepared by simplified methods of preparation known in the organosilicon organic synthesis art (see, for example, *The Chemistry of Organic Silicon Compounds,* Part 1 & 2, S. Patai and Z. Rappoport, eds., Wiley, New York 1989).

Typically, the couplers are associated with at least one silver halide emulsion layer coated on a support to form a photographic element. As used herein, the term "associated herewith" signifies that the coupler is incorporated in the silver halide emulsion layer or in a layer adjacent thereto, where, during processing, it is capable of reacting with the silver halide development products.

Typically the coupler is dissolved in a coupler solvent, and the solution is dispersed in an aqueous gelatin solution. Examples of coupler solvents that can be used are dibutyl phthalate, tricresyl phosphate, diethyl lauramide and 2,4-di-tert-amylphenol. In addition, an auxiliary coupler solvent known in the photographic art can be used.

The photographic elements according to the invention can be single color elements or multicolor elements. In a multicolor element, the dye-forming couplers as described can be associated with any of the emulsion layers or dye-forming units. If the coupler is a pyrazolone coupler, it is typically associated with a green-sensitive emulsion. The couplers can be associated with an emulsion layer sensitized to a region of the spectrum complementary to the dye formed by the coupler upon processing, although they can be associated with an emulsion sensitized to a different region of the spectrum, or with a panchromatically sensitized, orthochromatically sensitized or unsensitized emulsion. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders known in the art.

A typical multicolor photographic element comprises a support bearing a cyan dye image-forming unit comprised of at least one red-sensitive silver halide emulsion layer having associated therewith at least one cyan dye-forming coupler; a magenta dye image-forming unit comprised of at least one green-sensitive silver halide emulsion layer having associated therewith at least one magenta dye-forming coupler; and a yellow dye image-forming unit comprised of at least one blue-sensitive silver halide emulsion layer having associated therewith at least one yellow dye-forming coupler. The element can contain additional layers, such as filter layers. At least one of the layers of the element has a coupler of the invention associated with it.

In the following discussion of suitable materials for use in the emulsions and elements of the invention, reference will be made to *Research Disclosure,* December 1989, Item 308119, published by Kenneth Mason Publications, Dudley Annex, 21a North Street, Emsworth, Hampshire P010 7DQ, England. This publication will be identified hereinafter as "Research Disclosure".

The silver halide emulsion employed in the elements as described can be either negative-working or positive-working. Suitable emulsions and their preparation are described in Research Disclosure Section I and II and the publications cited therein. Suitable vehicles for the emulsion layers and other layers of elements of the invention are described in Research Disclosure Section IX and the publications cited therein.

In addition to the couplers described above, the element of the invention can include added couplers as described in Research Disclosure Section VII, paragraphs D, E, F, and G and the publications cited therein. These couplers can be incorporated in the elements and emulsions as described in Research Disclosure Section VII, paragraph C and the publications cited therein.

The photographic elements of the invention or individual layers thereof can contain brighteners (see Research Disclosure Section V), antifoggants and stabilizers (see Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section X), coating aids (see Research Disclosure Section XI), plasticizers and lubricants (see Research Disclosure Section XII), matting agents (see Research Disclosure Section XVI), and development modifiers (see Research Disclosure Section XXI).

The photographic element can be coated on a variety of supports as described in Research Disclosure Section XVII and the references cited therein.

Photographic elements as described can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the elements with a color developing agent to reduce developable silver halide and oxidize the color developing agent. The oxidized color developing agent in turn reacts with the coupler to yield dye. In this processing the coupling-off group as described is released.

Preferred color developing agents are p-phenylenediamines. Especially preferred are: 4-amino-N,N-diethylaniline hydrochloride; 4-amino-3-methyl-N,N-diethylaniline hydrochloride; 4-amino-3-methyl-N-ethyl-N-$\beta$-(methylsulfonamido)-ethylaniline sulfate hydrate; 4-amino-3-methyl-N-ethyl-N-$\beta$-(methylsulfonamido)-N,N-diethylaniline hydrochloride; 4-amino-N-ethyl-N-(2-methoxyethyl)-m-toluidine-di-p-toluene sulfonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the elements to render the unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The invention is further illustrated by the following examples, without being limited thereby.

SYNTHESIS EXAMPLE 1

Synthesis of Coupler (Sample 2):
N-(2-hydroxy-3,4-dichloro-3-trimethylsilyphenyl)-2-(2,4-di-tert-pentylphenoxy)butyramide The synthesis is illustrated in the following reaction scheme:

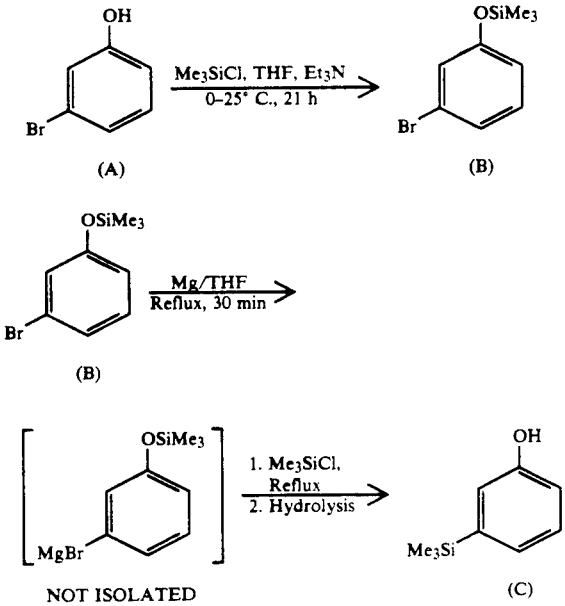

-continued

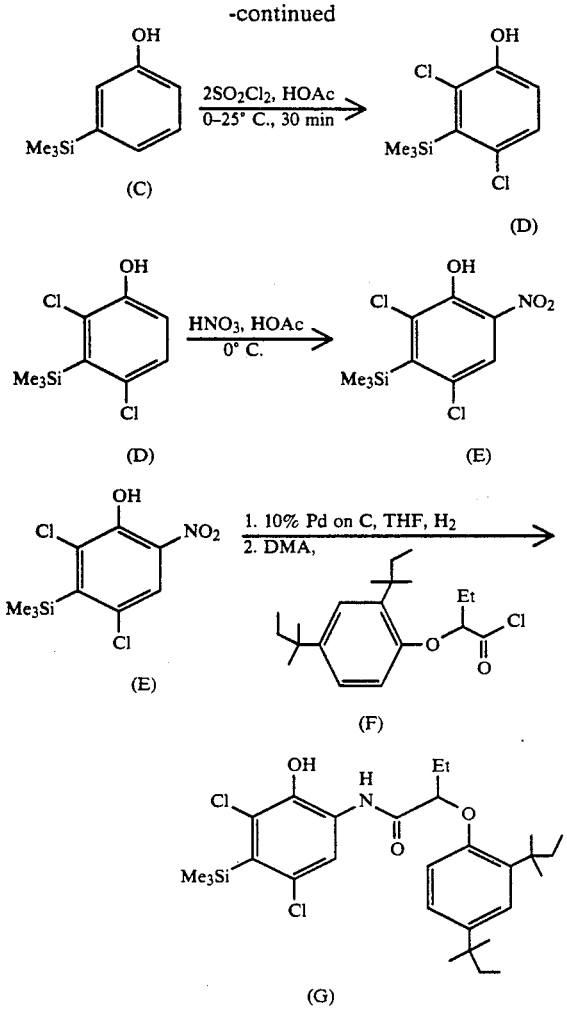

A dry 5 l, 3-neck flask with mechanical stirrer, connected to a mineral oil bubbler, was charged with m-bromophenol (A) (150 g, 870 mmol), dry tetrahydrofuran (THF, 2 l) and triethylamine (132.1 g, 1.3 mol). The contents of the flask were cooled to 0° C., and chlorotrimethylsilane was added dropwise. A voluminous white precipitate was formed. The reaction was allowed to equilibrate to room temperature over a period of 21 h. The mixture was then filtered to remove triethylamine hydrochloride. Removal of solvents precipitated some remaining hydrochloride salt. The mixture was further purified by repeatedly adding hexane followed by filtration to yield 3-bromo-O-trimethylsilylphenol (B) (207 g, 97% yield).

Next, a dry 3 l, 3-neck flask, equipped with a mechanical stirrer and reflux condenser, and connected to a mineral oil bubbler, was flushed with a stream of argon. The flask was charged with substituted phenol (B) (200 g, 800 mmol), fresh magnesium turnings (21.6 g, 0.89 mol), THF (900 ml), and maintained at about 0° C. in an ice bath. Methyl iodide (2 ml) was added as the catalyst to initiate reaction. The reaction was kept under control by carefully applying and removing the ice bath as necessary to counter the significant heat generated. The resulting mixture was gently heated to reflux for 30 min to drive the reaction to completion, as evidenced by the dissolution of the magnesium. Once again the mixture was cooled to 0° C. in an ice bath, and chlorotrimethylsilane (133.5 g, 1.2 moles) was added. The resulting mixture was gently refluxed and monitored by thin layer chromatography (TLC) to completion. The mixture was subsequently cooled to about 0° C., and 800 ml of water was slowly added to hydrolyze the silyl ether and magnesium salts. The organic layer was separated, washed with 2×100 ml portions of brine and dried over sodium sulfate. Removal of the volatile solvents provided 3-trimethylsilylphenol (C) as a yellow oil, further purified by flash chromatography (ligroin 950:ether=15:1) 116 g, 85% yield).

A 500 ml flask fitted with a magnetic stirring bar and a pressure-equalizing addition funnel connected to a mineral oil bubbler was flushed with a stream of argon. The flask was charged with the silyl-substituted phenol (C) (25 g, 0.15 mol), and glacial acetic acid (50 ml). The mixture was cooled to about 0° to 2° C., and sulfuryl chloride (42.5 g, 0.315 mol) was then added dropwise over 10 min. The ice bath was removed and the reaction was allowed to equilibrate to room temperature. Analysis by TLC revealed the reaction to be clean and complete in 30 min. The mixture was then poured into crushed ice, extracted with anhydrous ether (3×100 ml portions), washed with brine, and dried over magnesium sulfate. Removal of volatiles afforded a mixture of dichloro-3-trimethylsilylphenols, the major component (about 80%) being the desired regioisomer, 2,4-dichloro-3-trimethylsilylphenol as a pale yellow liquid (30.8 g, 88% yield).

A 250 ml flask was equipped with a magnetic stirring bar and an addition funnel. Silylphenol (D) (25.2 g, 0.107 mol) in a solution of glacial acetic acid (65 ml) was placed into the flask, and the solution was maintained at 0°–2° C. in an ice bath. To the well-stirred solution, freshly made nitrating mixture (12.5 g of 70% nitric acid in 35 ml of glacial acetic acid) was added dropwise and stirred. The mixture turned yellow, and finally red. The reaction was monitored by TLC (ligroin 950:EtOAc=2:1) to completion. The mixture was poured into a vigorously stirred crushed ice-water mixture, and the yellow solid filtered to furnish 2,4-dichloro-3-trimethylsilyl-5-nitrophenol (E) (28.5 g, 95% yield), essentially pure by $^1H$ NMR. A part (20 g) of the crude product was further purified by recrystallization from hot methanol (14.1 g, 71% yield).

HPLC: 99%, m.p. 70°–71° C. Elemental analysis for $C_9H_{11}Cl_2NO_3Si$: calculated: C: 38.58; H: 3.96; N: 5.00. found: C: 38.63; H: 3.97; N: 4.95.

Subsequently, the nitro-substituted silylphenol (E) (5.6 g, 20 mmol), dissolved in 50 ml of dry THF in a 500 ml Parr bottle, was hydrogenated in the presence of 10% palladium on a carbon catalyst (0.5 g). The reduction of the nitro group to an amino group was complete in 15 min (TLC analysis). The mixture was filtered under argon atmosphere through a 2" bed of celite to remove the catalyst. To the flask containing the amine solution in THF (well-stirred) was added N,N-dimethylaniline (2.66 g, 22 mmol) dissolved in THF (20 ml). The contents of the flask were cooled to about 0° C. in an ice bath, and 2-(2,4-di-tert-pentylphenoxy)butyryl chloride (F) (24 mmol) was added dropwise with vigorous stirring. The reaction was monitored by TLC to completion. The mixture was then poured into crushed ice, extracted with 3×100 ml portions of anhydrous ether. The combined extracts were washed with brine, dried over magnesium sulfate, and the solvents were removed on a rotary evaporator to afford a red oil. This was subjected to flash chromatography (ligroin 950:Et- $_2O$=15:1) to give the desired coupler (G) (3.4 g, 31% yield) as a brown solid. The coupler was further purified by recrystallization from acetonitrile.

HPLC: 96.4%, m.p. 101°–103° C. Elemental analysis: calculated: C: 63.03; H: 7.84; N: 2.53. found: C: 63.16; H: 7.61; N: 2.67.

SYNTHESIS EXAMPLE 2

Synthesis of Coupler (Sample 4):
N-(2-hydroxy-3,4-dichloro-3-trimethylsilylphenyl)-2-(3-pentadecylphenoxy)butyramide.

The synthesis is illustrated in the following reaction scheme:

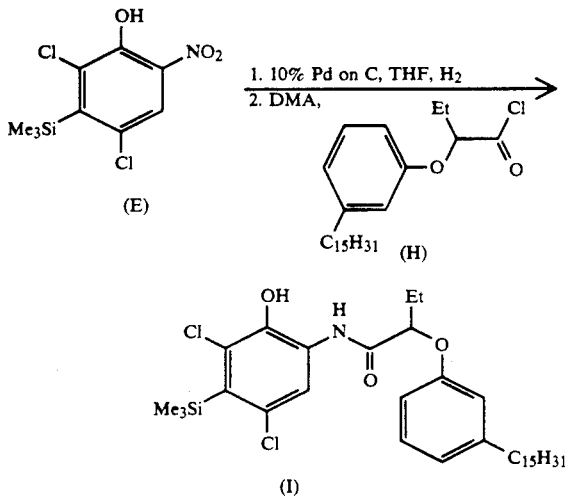

2,4-Dichloro-3-trimethylsilyl-5-nitrophenol (E) (7 g, 25 mmol), dissolved in dry THF (45 ml), was reduced to the corresponding amine in the presence of 10% palladium on carbon catalyst. The reaction was complete in 10 min, and to the resulting THF solution of the amine, N,N-dimethylaniline (3.8 g, 31.3 mmol) was added. The resulting mixture was cooled and a solution of 2-(3-pentadecylphenoxy)butyryl chloride (H) (31.25 mmol) was added dropwise under argon. The reaction was complete in 5 min (TLC, ligroin 950:EtOAc, 5:1). Usual work-up followed by flash chromatography afforded a yellow oil which solidified on standing (3.4 g). Recrystallization from warm acetonitrile afforded the pure coupler (I) (1.7 g).

HPLC: 97.3%, m.p. 49°–50° C. Elemental analysis: calculated: C: 65.57; H: 8.58; N: 2.25. found: C: 65.56; H: 8.57; N: 2.51.

SYNTHESIS EXAMPLE 3

Synthesis of Coupler:
N-(2-hydroxy-3,5-dichloro-4-triethylsilylphenyl)-2-(2,4-di-tert-pentylphenoxy)butyramide.

The synthesis is illustrated in the following reaction scheme:

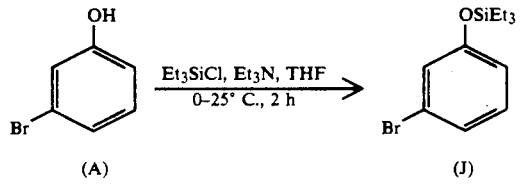

-continued

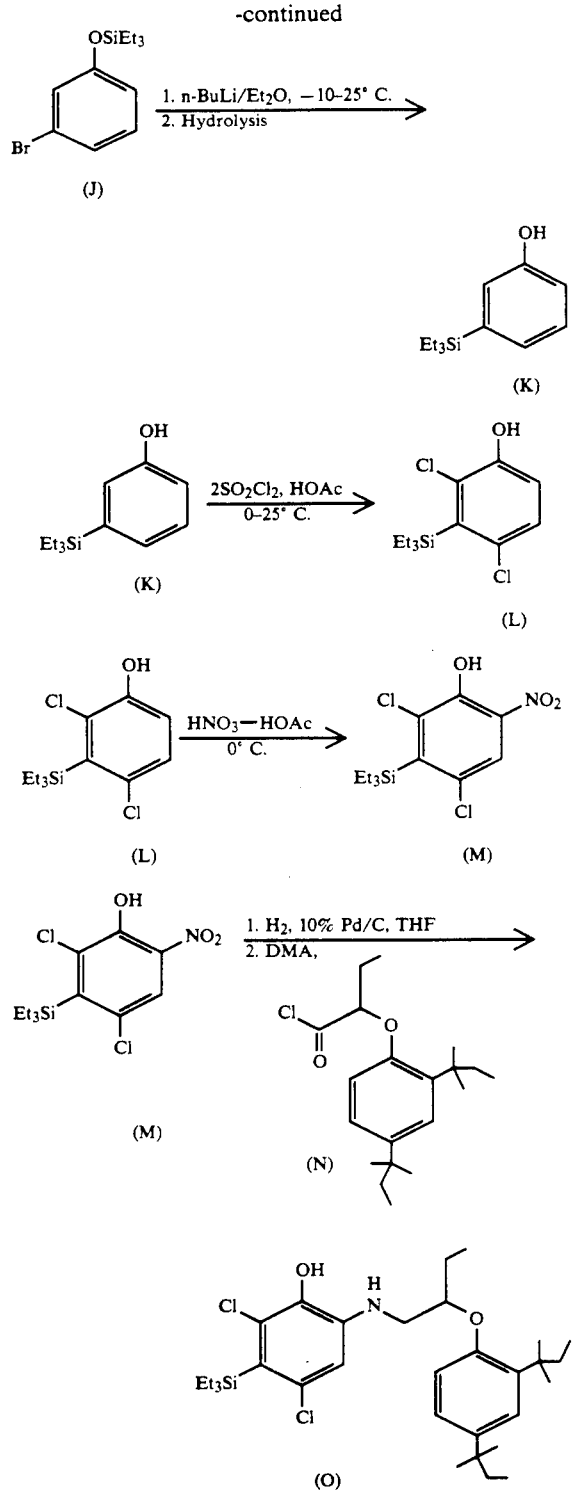

A 500 ml flask was charged with 3-bromophenol (A) (25 g, 144 mmol), THF (200 ml) and triethylamine (14.67 g, 145 mmol). The flask was cooled to 0° C. in an ice bath, and chlorotriethylsilane (21.8 g, 144 mmol) was added dropwise. The mixture was allowed to stir at room temperature to completion over 2 h. The hydrochloride salt was then filtered. Removal of solvents followed by flash chromatography afforded 3-bromo-O-triethylsilylphenol (J) as a clear liquid (30.4 g, 73%).

HPLC=96%.

A 500 ml flask equipped with a magnetic stirring bar and a pressure equalizing addition funnel, maintained under static argon atmosphere, was charged with silane (J) (45 g, 157 mmol) dissolved in diethyl ether (100 ml). To this vigorously stirred mixture, maintained at −10° C. in an ice-acetone bath, n-butyllithium (2.5M solution in hexane, 75 ml, 188 mmol) was added dropwise over a period of 20 min. Then the mixture was allowed to warm to room temperature. The reaction was complete in 3 h (TLC, ligroin 950:EtOAc=5:1). The mixture was poured into 250 ml of cold water and acidified with hydrochloric acid. The organic layer was separated and the aqueous layer extracted with 3×75 ml portions of ether. The combined extracts were dried over magnesium sulfate, and solvents removed on a rotary evaporator to yield an orange oil, which on purification by flash chromatography (ligroin 950:$Et_2O$=7:1) furnished 3-triethylsilylphenol (K) (23.7 g, 73% yield) as a pale yellow liquid.

The next experimental set-up was the same as in trimethyl analog previously described. The flask was charged with the silylphenol (K) (18 g, 86 mmol), dissolved in glacial acetic acid (30 ml), and maintained at 0°-2° C. Sulfuryl chloride (24.5 g, 181.4 mmol) was then added dropwise. The mixture was allowed to equilibrate to room temperature and monitored by TLC to completion (ligroin 950:EtOAc=10:1). Usual work-up furnished dichloro-3-triethylsilylphenols (22.7 g, 95% yield). $^1H$ NMR analysis revealed the mixture to be predominantly (about 85%) 2,4-dichloro-3-triethylsilylphenol (L), essentially pure to be utilized for further reactions.

To a solution of the substituted silylphenol (L) (20 g, 72 mmol) in glacial acetic acid (40 ml), maintained at 0°-2° C., nitrating mixture (prepared by the addition of 94 mmol of 70% nitric acid to 30 ml of glacial acetic acid at 0° C.) was added through an addition funnel. The reaction was complete in 15 min (TLC). Usual work-up followed by flash chromatography (ligroin 950:EtOAc=10:1) furnished 2,4-dichloro-3-triethylsilyl-5-nitrophenol (M) as a red-orange liquid (17.1 g, 74% yield).

Next, the nitrophenol (M) (8.2 g, 25.4 mmol), dissolved in dry THF (60 ml), was reduced to the corresponding amine in the presence of 10% palladium on carbon (10 min) at room temperature. The solution was filtered through celite into a 250 ml reaction flask containing N,N-dimethylaniline (33 mmol) in 10 ml of THF. 2,4-Di-tert-pentylphenoxybutyryl chloride (N) (10.17 g, 30 mmol) dissolved in THF (10 ml), was added dropwise under argon with vigorous stirring. The reaction was complete in 5 min (TLC, ligroin 950:EtOAc=5:1). The mixture was worked up and the desired coupler (O) was purified by flash chromatography (ligroin 950:EtOAc= 15:1) followed by recrystallization from methanol (4.2 g).

HPLC: 99%, m.p. 130° C. Elemental analysis: calculated: C: 64.63; H: 8.30; N: 2.36. found: C: 64.73; H: 8.01; N: 2.36.

Other similar couplers can be prepared in the same manner but replacing the specified silyl group with, for example:

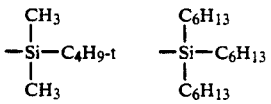

-continued

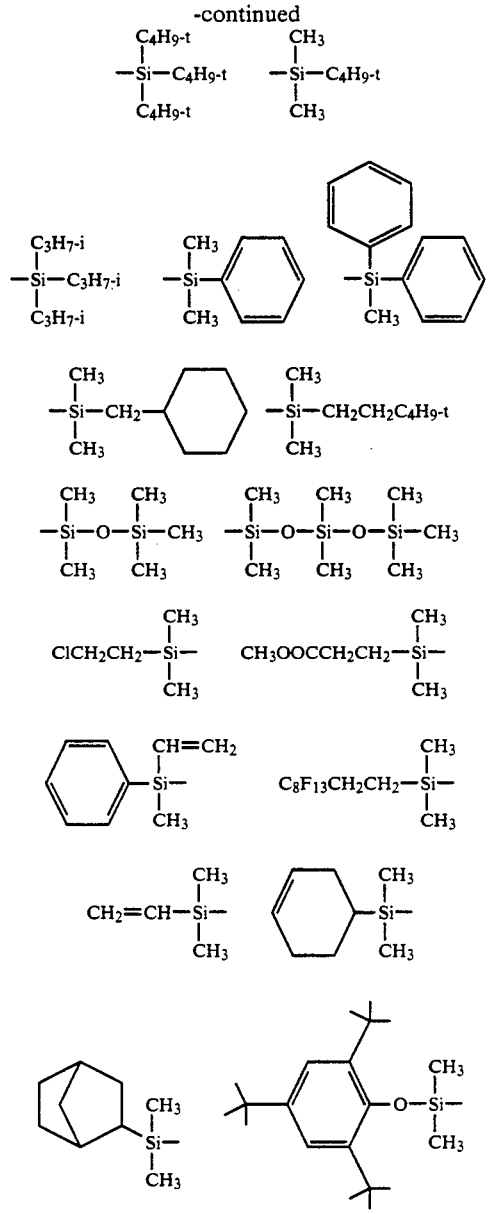

In dimeric coupler according to the invention, the silyl group can be, for example:

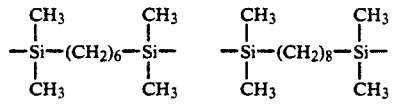

EXAMPLES 1-4

Photographic elements were prepared by coating a gel-subbed polyethylene-coated paper support with a photosensitive layer containing a silver chloride emulsion at 0.215 g Ag/$m^2$, gelatin at 1.24 g/$m^2$, and each cyan image dye-forming coupler indicated in Table I at 0.832 mmol/$m^2$ dispersed in half its weight of dibutyl phthalate. The photosensitive layer was overcoated with a protective layer containing 1.08 g/$m^2$ gelatin and bis(vinylsulfonylmethyl)ether hardener at 2 wt % based on total gelatin. The format is shown below:

| | |
|---|---|
| OC | Gelatin (1.35 g/m$^2$)<br>bis(vinylsulfonylmethyl) ether hardener (2 wt % based on total gelatin) |
| PHOTO-SENSITIVE LAYER | Gelatin (1.24 g/m$^2$)<br>AgCl emulsion (0.215 g Ag/m$^2$)<br>cyan image dye-forming coupler from Table I (0.832 mmol/m$^2$), dispersed in half its weight of dibutyl phthalate |
| FILMBASE | gel-subbed polyethylene-coated paper |

The photographic elements were developed and fixed, then washed and dried. The compositions of the processing baths were as follows:

| | |
|---|---|
| Color developer (pH 10.15) | |
| Triethanolamime | 12.41 g |
| Lithium polystyrenesulfonate (30% soln.) | 0.30 g |
| N,N-diethylhydroxylamine (85% soln.) | 5.40 g |
| 4-Amino-3-methyl-N-ethyl-N-(methanesulfonamido) ethylaniline sulfate hydrate | 5.00 g |
| Stilbene whitening agent | 2.30 g |
| 1-Hydroxyethylene-1,1-diposphonic acid (60% soln.) | 1.16 g |
| Lithium sulfate | 2.70 g |
| Potassium carbonate (anhydrous) | 21.16 g |
| Potassium bicarbonate | 2.79 g |
| Potassium chloride | 1.60 g |
| Potassium bromide | 0.028 g |
| Potassium hydroxide (45% soln.) | 0.816 ml |
| Water to make | 1.0 L |
| Bleach-Fix bath (pH 6.8) | |
| Ammonium thiosulfate | 104.0 g |
| Sodium hydrogen sulfite | 13.0 g |
| Ferric ammonium ethylenediamine tetraacetic acid (EDTA) | 65.6 g |
| EDTA | 6.56 g |
| Ammonium hydroxide | 27.9 g |
| Water to make | 1.0 L |

Densitometry with red light provided measurements, as shown in Table I, of fog (Dmin), peak wavelength absorption (λmax), and band-width at half the peak absorption (HBW). Cyan step images on processed film strips were subjected to the following tests and density losses were noted:

I) 4-week fading under a 50 Klux daylight xenon exposure, using a Wratten 2B filter to remove the UV component II) Ferrous ion stability by a 5 min immersion at room temperature in the following stirred solution:

| 0.1M Ferrous Ion Solution (produced under $N_2$purge) | |
|---|---|
| Degassed distilled water | 750 ml |
| EDTA | 32.12 g |
| Ammonium hydroxide (conc. solution) | 15 ml |
| Ferrous sulfate.$7H_2O$ | 27.8 g |
| Ammonium hydroxide and water to | 1 l |
| (Nitric acid to adjust pH to 5.0) | |

TABLE I

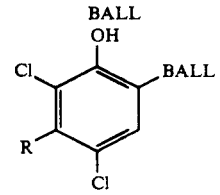

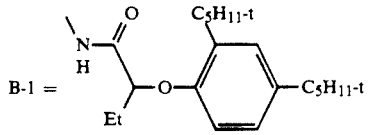

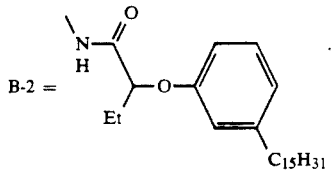

| Sample | Ballast | R | Dmin | λmax (nm) | HBW (nm) | $Fe^{+2}$ Redn . . . % | Light fade, % | mp, °C. |
|---|---|---|---|---|---|---|---|---|
| 1. Comp | B-1 | $-C_2H_5$ | 0.084 | 664 | 174 | −26 | −23 | 138-9 |
| 2. Invn. | B-1 | $-Si(CH_3)_3$ | 0.076 | 680 | 172 | −11 | −22 | 101-3 |
| 3. Comp. | B-2 | $-C_2H_5$ | 0.087 | 663 | 178 | −57 | −22 | 67-69 |
| 4. Invn. | B-2 | $-Si(CH_3)_3$ | 0.079 | 674 | 181 | −23 | −14 | 49-50 |

Invn. = samples of the invention; Comp. = comparisons

The data shows that the silyl-substituted couplers of the invention provided dyes with markedly more bathochromic hues than the comparisons, yet with similar bandwidths and comparable to better stability to light fade. In addition, they yielded slightly less foggy images and were much less sensitive to reduction by ferrous ion found in exhausted processing solutions. The lower melting point ranges for the silyl couplers correlated with better coupler dispersibility compared with their non-silyl analogs.

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising a support and a silver halide emulsion layer having associated therewith a coupler having in a non-coupling position a silyl substituent represented by the formula:

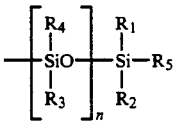

wherein $R_1$ through $R_4$ individually are unsubstituted or substituted aliphatic, aromatic or heterocyclic groups, $R_5$ is an unsubstituted or substituted aliphatic, aromatic or heterocyclic group which can be bonded to a non-coupling position of a second coupler moiety, and N=0, 1 or 2 with the proviso that an Si atom of the silyl substituent is bonded directly to the coupler nucleus.

2. A photographic element as claimed in claim 1, wherein said coupler is represented by the formula:

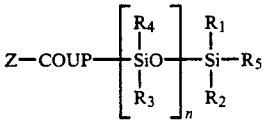

wherein

COUP is a coupler moiety;

Z is H or a coupling-off group bonded to a coupling position of COUP;

$R_1$-$R_5$ individually are unsubstituted or substituted aliphatic, aromatic or heterocyclic groups; and n is 0, 1 or 2.

3. A photographic element as claimed in claim 1, wherein said coupler is represented by the formula:

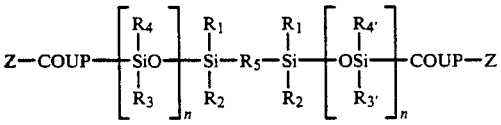

wherein both COUP moieties are a coupler moiety which may be the same or different;

both Z moieties are H or a coupling-off group bonded to a coupling position of COUP, wherein the Z's may be the same or different;

$R_1$-$R_5$, $R_3$, and $R_4$, are unsubstituted or substituted aliphatic, aromatic or heterocyclic groups;

wherein each of the R groups may be the same or different and each n is the same or different and is 0, 1, or 2.

4. A photographic element as claimed in claim 1, wherein $R_1$, $R_2$ and $R_5$ are unsubstituted or substituted alkyl groups wherein these groups may be the same or different.

5. A photographic element as claimed in claim 1, wherein the silyl substituent is selected from the group consisting of:

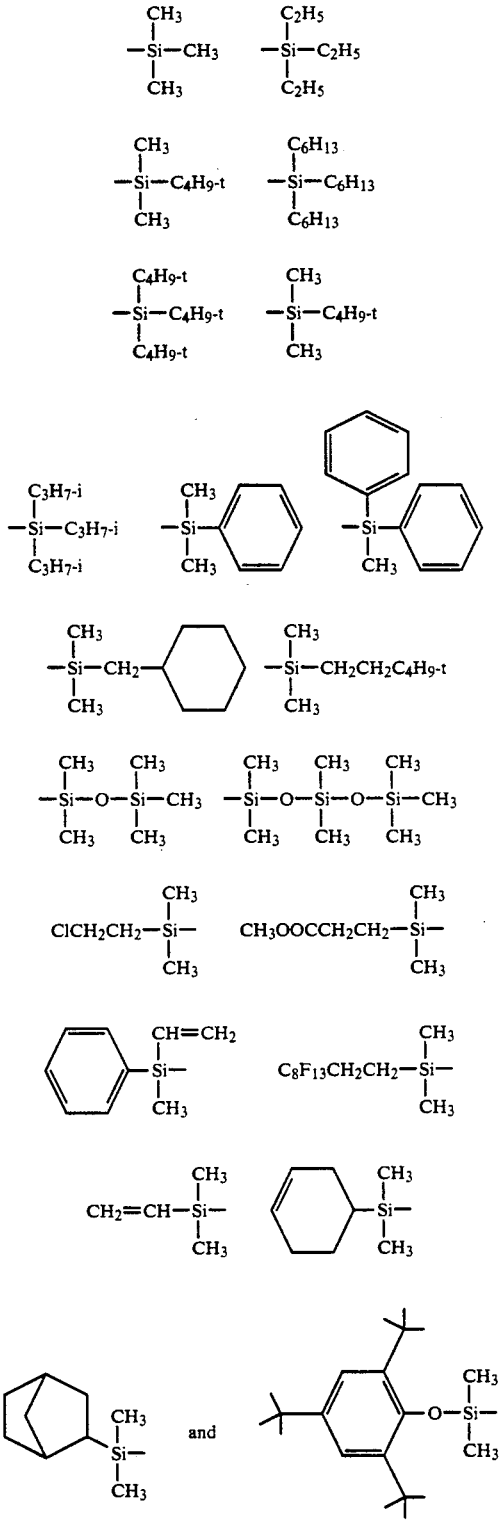

6. A photographic element as claimed in claim 3, wherein $R_5$ is an alkyl group containing 1 to 30 carbon atoms.

7. A photographic element as claimed in claim 6, wherein the silyl substituent is selected from the group consisting of

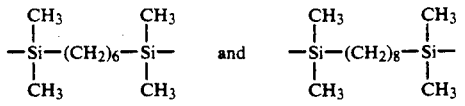

8. A photographic element as claimed in claim 1 wherein said coupler is a cyan, magenta or yellow image dye-forming coupler.

9. A photographic element as claimed in claim 1 wherein said coupler is an acetanilide, pyrazolone, pyrazoloazole, phenolic or naphtholic coupler.

10. A photographic element as claimed in claim 1, wherein said coupler is

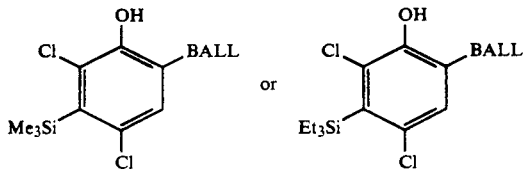

wherein BALL is a ballast group.

11. A photographic element as claimed in claim 1, wherein n=0.

12. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, wherein at least one of said image forming units comprises a coupler having in a non-coupling position a silyl substituent represented by the formula:

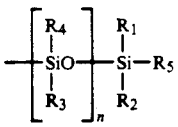

wherein $R_1$ through $R_4$ individually are unsubstituted or substituted aliphatic, aromatic or heterocyclic groups, $R_5$ is an unsubstituted or substituted aliphatic, aromatic or heterocyclic group which can be bonded to a non-coupling position of a second coupler moiety, and n=0, 1 or 2 with the proviso than an Si atom of the silyl substituent is bonded directly to the coupler nucleus.

13. A process for developing an image in a photographic element comprising a support and a silver halide emulsion containing an imagewise distribution of developable silver halide grains, said process comprising the step of developing said element with a silver halide color developing agent in the presence of a photographic coupler having in a non-coupling position a silyl substituent represented by the formula:

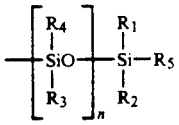

wherein $R_1$ through $R_4$ individually are unsubstituted or substituted aliphatic, aromatic or heterocyclic groups, $R_5$ is an unsubstituted or substituted aliphatic, aromatic or heterocyclic group which can be bonded to a non-coupling position of a second coupler moiety, and n=0, 1 or 2 with the proviso than an Si atom of the silyl substituent is bonded directly to the coupler nucleus.

14. A photographic silver halide emulsion comprising a photographic coupler having in a non-coupling position a silyl substituent represented by the formula:

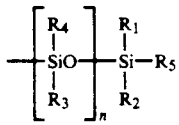

wherein $R_1$ through $R_4$ individually are unsubstituted or substituted aliphatic, aromatic or heterocyclic groups, $R_5$ is an unsubstituted or substituted aliphatic, aromatic or heterocyclic group which can be bonded to a non-coupling position of a second coupler moiety, and n=0, 1 or 2 with the proviso that an Si atom of the silyl substituent is bonded directly to the coupler nucleus.

15. A photographic silver halide emulsion as claimed in claim 14, wherein said coupler is represented by the formula:

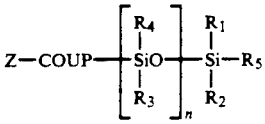

wherein

COUP is a coupler moiety;

Z is H or a coupling-off group bonded to a coupling position of COUP;

$R_1$-$R_5$ are unsubstituted or substituted aliphatic, aromatic or heterocyclic groups, wherein each of the R groups may be the same or different; and n is 0, 1 or 2.

16. A photographic silver halide emulsion as claimed in claim 14, wherein said coupler is represented by the formula:

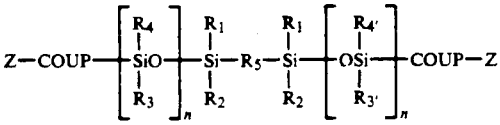

wherein both COUP moieties are a coupler moiety which may be the same or different;

both Z moieties are H or a coupling-off group bonded to a coupling position of COUP, wherein the Z's may be the same or different;

$R_1$-$R_5$, $R_3$, and $R_4$, are unsubstituted or substituted aliphatic, aromatic or heterocyclic groups;

wherein each of the R groups may be the same or different and each n is the same or different and is 0, 1 or 2.

17. A photographic element as claimed in claim 1, wherein n is 1.

18. A photographic element as claimed in claim 1, wherein n is 2.

19. A photographic element as claimed in claim 3, wherein at least one of the n's is 1.

20. A photographic element as claimed in claim 3, wherein at least one of the n's is 2.

21. A photographic element as claimed in claim 3, wherein both of the n's are 0.

22. A photographic element as claimed in claim 1, wherein n is zero and each of the R groups are the same or different alkyl groups.

23. A photographic element as claimed in claim 1, wherein the coupler comprises, in addition to the silyl substituent, a ballast group.

24. A photographic element as claimed in claim 23, wherein the ballast and silyl substituent are attached to different positions on the coupler.

25. A photographic element as claimed in claim 1, wherein the silyl substituent becomes part of the chromophore of the dye forming from the coupler.

26. A photographic element as claimed in claim 1, wherein the coupler is a cyan, magenta, universal, black, or colorless dye-forming coupler.

27. A photographic element as claimed in claim 1, wherein the coupler is a cyan, yellow, universal, black, or colorless dye-forming coupler.

28. A photographic element as claimed in claim 1, wherein the coupler is a phenol cyan dye-forming coupler.

29. A photographic element comprising a support and a silver halide emulsion layer having associated therewith a coupler having in a non-coupling position a silyl substituent represented by the formula:

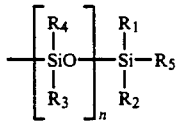

wherein $R_1$ through $R_4$ individually are unsubstituted or substituted aliphatic, aromatic or heterocyclic groups, $R_5$ is an unsubstituted or substituted aliphatic, aromatic or heterocyclic group which can be bonded to a non-coupling position of a second coupler moiety, and n=0, 1 or 2, with the proviso that an Si atom of the silyl substituent is bonded directly to the coupler nucleus, wherein the coupler is a cyan, magenta, universal, colorless, or black dye-forming coupler.

30. A photographic element as claimed in claim 29, wherein the coupler is a cyan, universal, colorless, or black dye-forming coupler.

31. A photographic element comprising a support and a silver halide emulsion layer having associated therewith a coupler having in a non-coupling position which forms part of the chromophore of the dye, a silyl substituent represented by the formula:

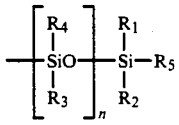

wherein $R_1$ through $R_4$ individually are unsubstituted or substituted aliphatic, aromatic or heterocyclic groups, $R_5$ is an unsubstituted or substituted aliphatic, aromatic or heterocyclic group which can be bonded to a non-coupling position of a second coupler moiety, and n=0, 1 or 2, with the proviso that an Si atom of the silyl substituent is bonded directly to the coupler nucleus.

* * * * *

UNITED STATES PATENT AND TRADEMARK OFFICE

CERTIFICATE OF CORRECTION

PATENT NO. : 5,306,604
DATED : April 26, 1994
INVENTOR(S) : Sundaram Krishnamurthy It is certified that error appears in the above-indentified patent and that said Letters Patent is hereby corrected as shown below:

Column 21, line 21, "N=0, 1 or 2" should read --n=0, 1 or 2--.

Signed and Sealed this

Ninth Day of August, 1994

*Attest:*

Bruce Lehman

BRUCE LEHMAN

*Attesting Officer*

*Commissioner of Patents and Trademarks*